US005572838A

United States Patent [19]

Truitt et al.

[11] Patent Number: 5,572,838

[45] Date of Patent: Nov. 12, 1996

[54] STRONGBACK ATTACHMENT SYSTEM

[75] Inventors: Robert E. Truitt, Carson, Calif.; Mark E. Kaler, Centerville, Ohio

[73] Assignee: Dayton Superior Corporation, Miamisburg, Ohio

[21] Appl. No.: 495,368

[22] Filed: Jun. 28, 1995

[51] Int. Cl.[6] ..... F04G 17/00

[52] U.S. Cl. ..... 52/127.2; 249/150; 411/552; 411/553

[58] Field of Search ..... 52/127.1, 127.3, 52/127.7, 704, 705, 706, 707, 127.2; 411/551, 552, 553, 549; 249/91, 93, 96, 97, 63.150

[56] References Cited

U.S. PATENT DOCUMENTS

| | | | |
|---|---|---|---|
| 3,431,012 | 3/1969 | Courtois et al. | 294/86 |
| 3,705,469 | 12/1972 | Eriksson | 249/63 X |
| 5,212,920 | 5/1993 | Tye | 52/127.1 |

*Primary Examiner*—Carl D. Friedman
*Assistant Examiner*—Creighton Smith
*Attorney, Agent, or Firm*—Biebel & French

[57] ABSTRACT

A strongback attachment system for temporarily attaching a reinforcing beam or the like to a poured concrete structural member includes an insert adapted to be set in the poured concrete member. The insert has a body for creating a void in the concrete structural member and a base for supporting the body in spaced relation above a floor of the concrete structural member. The base has a pair of leg members in which a portion thereof extends through the body so as to be free of concrete. A bolt is also provided for securing the reinforcing beam to the concrete structural member, where the bolt includes a shaft with a threaded end and an opposite end terminating in an engagement head. The engagement head is adapted to be releasably engaged by the leg member portions extending through the body. The leg member portions extending through the body of the insert are substantially parallel and the engagement head is configured to pass between the leg member portions when oriented in a first position and to become retained by the leg member portions when oriented in a second position. The strongback attachment system also includes a spring biased portion on the bolt adjacent the engagement head to bias the bolt away from the leg member portions and thereby promote the retention of the engagement head by the leg member portions.

24 Claims, 6 Drawing Sheets

10
14
12
14
13
15

STRONGBACK ATTACHMENT SYSTEM

BACKGROUND OF THE INVENTION

1. Field of the Invention

The present invention relates generally to the field of poured or cast concrete construction, and, more specifically, to an attachment system for strongback beams on concrete panels to reinforce the panel against fracture or damage during a tilt-up operation.

2. Description of Related Art

One technique for erecting concrete structures involves the formation of concrete slabs or panels, generally at the construction site, and thereafter tilting such panels up into place. Oftentimes, openings are required in the concrete panels which will normally create extreme bending stresses in the remaining concrete sections. Although internal reinforcing steel may be utilized, one common way to counter such bending stresses and increase the stiffness of the panel is the use of strongback beams, or "strongbacks," which are attached temporarily to the concrete panel.

Strongbacks are an efficient and economical method and generally involve the use of wood or steel beams being attached at critical locations. One manner of attaching strongbacks to a concrete panel is described in the Dayton Superior Corporation's tilt-up construction handbook and involves a strongback bolt being threadably engaged with a strongback insert positioned within the concrete panel. However, it has been found that this method of attachment is somewhat time-consuming and an attachment method which would allow quick and simple connection and release would be desirable.

In this regard, a strongback attachment system described in U.S. Pat. No. 5,212,920, to Richmond Screw Anchor Company, describes a system which is quickly installed. As seen therein, the '920 patent discloses a strongback attachment system which includes a bolt-type assembly, an insert, and a strongback beam. The insert, which is in the form of a support chair, includes a substantially U-shaped member which may be engaged by one end of the bolt assembly. More specifically, the engagement head of the bolt assembly has a slot formed therein which is sized to receive the U-shaped member. Thereafter, a pair of hook elements adjacent to the slot engage the U-shaped member by a twist of the bolt assembly and a spring loaded pin retains it in engagement with the hook elements.

Although the strongback attachment system described in U.S. Pat. No. 5,212,920 is able to perform its intended function, it has been found that the engagement head utilized therein is relatively complicated and expensive to produce. Moreover, alignment of the bolt assembly engagement head with the U-shaped member of the insert provides very little in the way of tolerance. Therefore, it would be desirable for a strongback attachment system to be developed which not only is able to be connected and disconnected quickly, but one which is simpler and more economical in design.

Accordingly, one object of the present invention is to provide a strongback attachment system which allows a strongback beam to be connected and disconnected quickly and simply.

Another object of the present invention is to provide a strongback attachment system which is self contained.

Yet a further object of the present invention is to provide a strongback attachment system which has a simple and economic design.

Still a further object of the present invention is to provide a strongback attachment system which provides a more stable connection to the insert embedded in the concrete panel.

SUMMARY OF THE INVENTION

In accordance with one aspect of the present invention, a strongback attachment system for temporarily attaching a reinforcing beam or the like to a poured concrete structural member includes an insert adapted to be set in the poured concrete member. The insert has a body for creating a void in the concrete structural member and a base for supporting the body in spaced relation above a floor of the concrete structural member. The base has a pair of leg members in which a portion thereof extends through the body so as to be free of concrete. A bolt is also provided for securing the reinforcing beam to the concrete structural member, where the bolt includes a shaft with a threaded end and an opposite end terminating in an engagement head. The engagement head is adapted to be releasably engaged by the leg member portions extending through the body. The leg member portions extending through the body of the insert are substantially parallel and the engagement head is configured to pass between the leg member portions when oriented in a first position and to become retained by the leg member portions when oriented in a second position. The strongback attachment system also includes a spring biased portion on the bolt adjacent the engagement head to bias the bolt away from the leg member portions and thereby promote the retention of the engagement head by the leg member portions.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
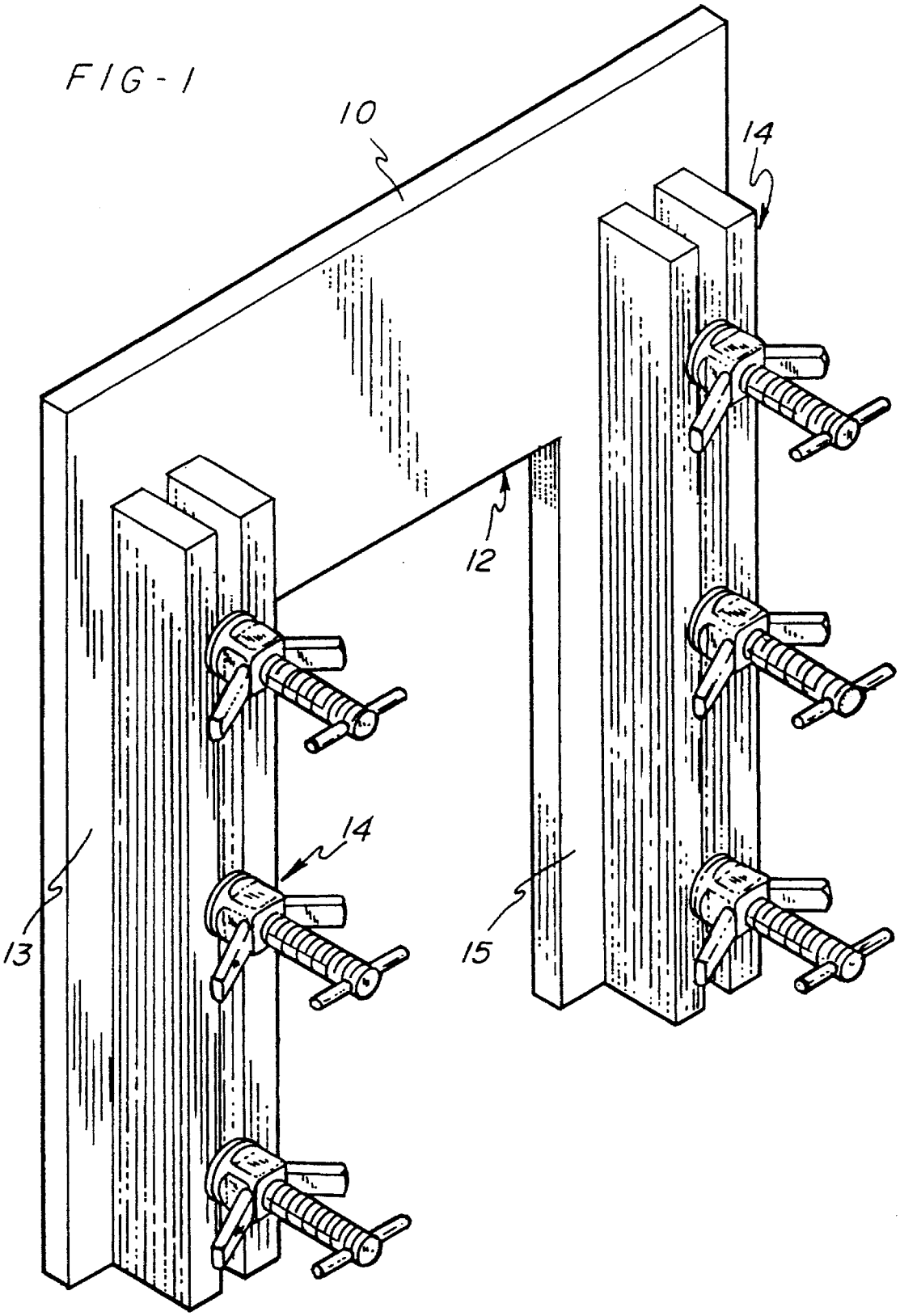
FIG. 1 is a perspective view of a concrete structural body including a strongback system of the present invention employed therewith.

Referring now to the drawings in detail, wherein identical numerals indicate the same elements throughout the figures, FIG. 1 depicts a concrete panel 10 having an opening 12 therein. As will be understood by one skilled in the art, opening 12 will normally create bending stresses in the remaining sections of concrete panel 12 during tilt-up construction of concrete panel 10, especially sections 13 and 15 adjacent to opening 12. Accordingly, a strongback system, depicted generally by the numeral 14, is utilized to account for such bending stresses by increasing the stiffness of panel 10 at certain specified locations.

Figure 2:
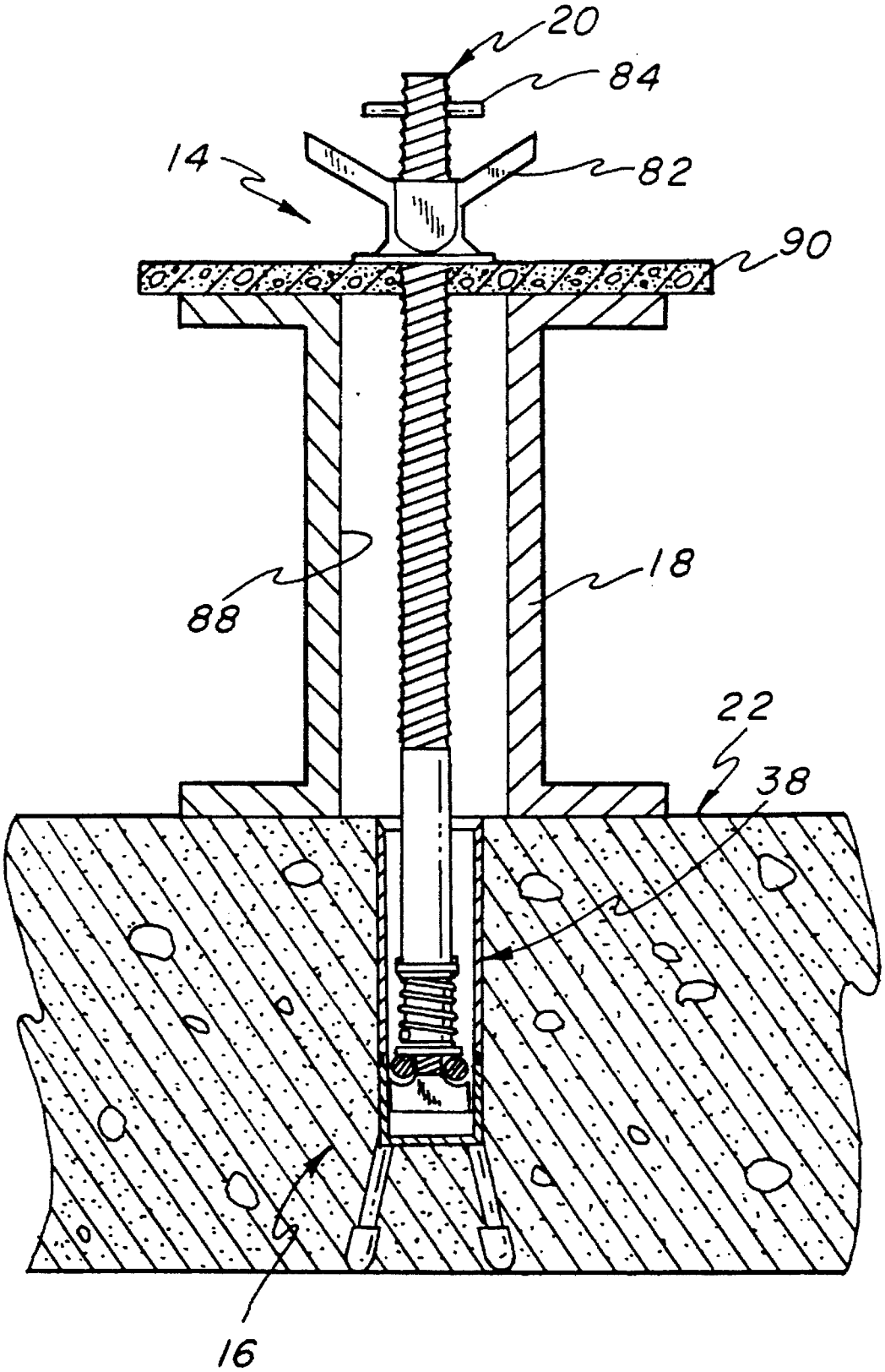
FIG. 2 is a partial, cross-sectional view of FIG. 1.

As best seen in FIG. 2, strongback system 14 includes a strongback insert 16, a strongback beam 18, and a strongback bolt 20. It will be understood that strongback beam 18 is secured to a surface 22 of concrete panel 10 by extending strongback bolt 20 therethrough and connecting strongback bolt 20 to strongback insert 16 embedded within concrete panel 10.

Figure 3:
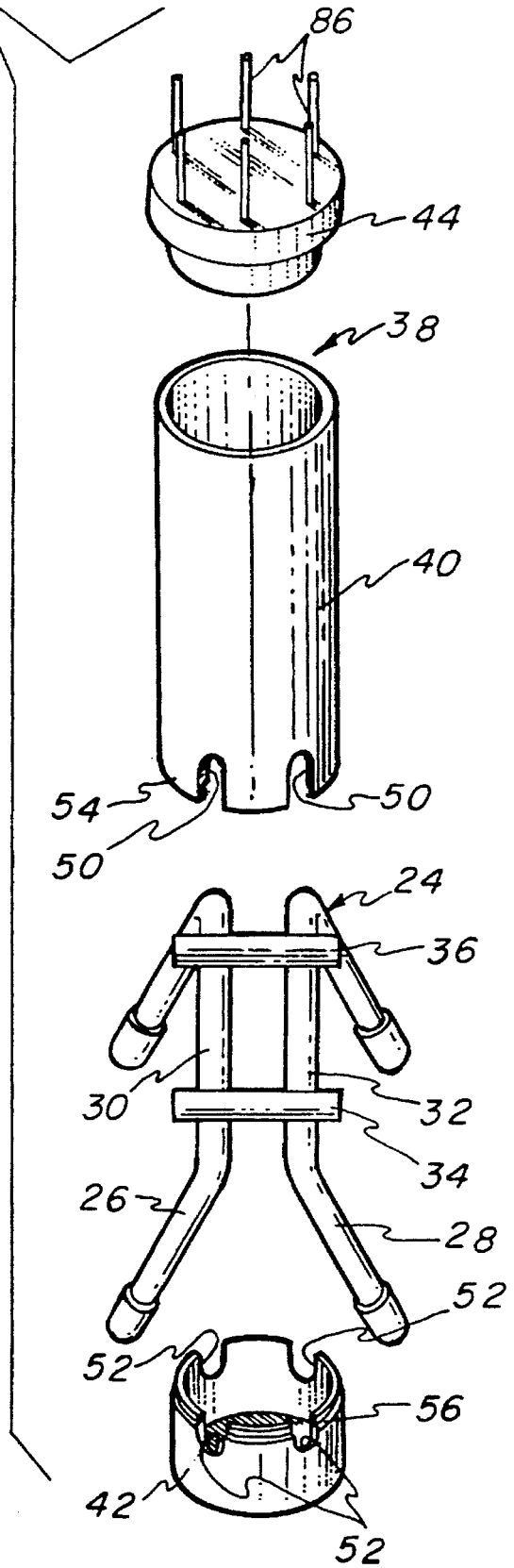
FIG. 3 is an exploded side perspective view of the strongback insert depicted in FIG. 2 which includes a cap portion not shown in FIG. 2.

More specifically, as seen in FIG. 3, strongback insert 16 includes a base 24 which preferably is in the form of a wire support chair. It will be understood that base 24 preferably includes a first leg member 26 and a second leg member 28, which are generally of a U-shaped design. First and second leg members 26 and 28, which preferably are plastic protected load bearing wires, include portions 30 and 32 which are oriented generally horizontally in a plane through concrete panel 10 parallel to surface 22 and are connected by cross members 34 and 36. First and second leg members 26 and 28 may also preferably be angled away from each other in order to enhance stability.

Strongback insert 16 also includes a substantially cylindrical plastic body 38 having an upper portion 40 and a lower portion 42, as well as a removable cap portion 44. When positioned within a form for concrete panel 10, strongback insert 16, by means of body 38, is able to provide an area free of concrete or a void 39 (see FIGS. 5 and 6). Upper and lower portions 40 and 42 are preferably mated by means of a tongue and groove design, but other similar connecting means may be utilized.

It will be noted that upper and lower body portions 40 and 42 preferably include semi-circular slots 50 and 52 along their respective mating edges 54 and 56, whereby a seal is formed around horizontal portions 30 and 32 of first and second leg members 26 and 28 which are positioned through body 38. However, it will be understood that upper body portion 40 or lower body portion 42 may include aligned circular openings therethrough which may receive first and second leg members 26 and 28. Accordingly, a length of horizontal portions 30 and 32 are contained within void 39 formed by body 38 so that they are not exposed to concrete. It is these lengths of horizontal portions 30 and 32 to which strongback bolt 20 may be connected as described hereinafter.

Figure 4:
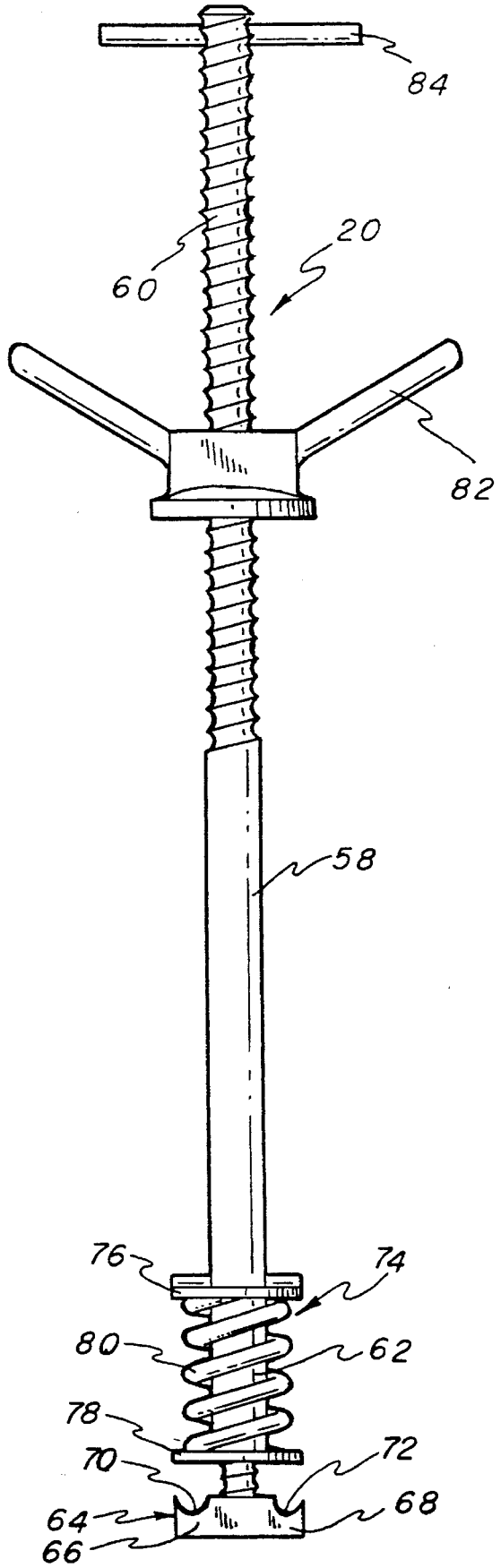
FIG. 4 is a side view of the strongback bolt depicted in FIG. 2.

FIG. 4 depicts in greater detail strongback bolt 20 as having a shaft 58 with a threaded end 60 and an opposite end 62 from which an engagement head 64 terminates. Engagement head 64, which preferably is substantially T-shaped, is attached to end 62 of shaft 58 by a threaded engagement within the interior of shaft 58 (although other manners of attachment may be used). In this way, the length in which engagement head 64 extends beyond end 62 of shaft 58 may be adjusted for specific applications as desired. It will be noted that engagement head 64 includes a pair of diametrically opposed flanges 66 and 68 in which arcuate slots 70 and 72, respectively, are preferably provided to enhance connection to horizontal portions 30 and 32 of first and second leg members 26 and 28.

Figure 5:
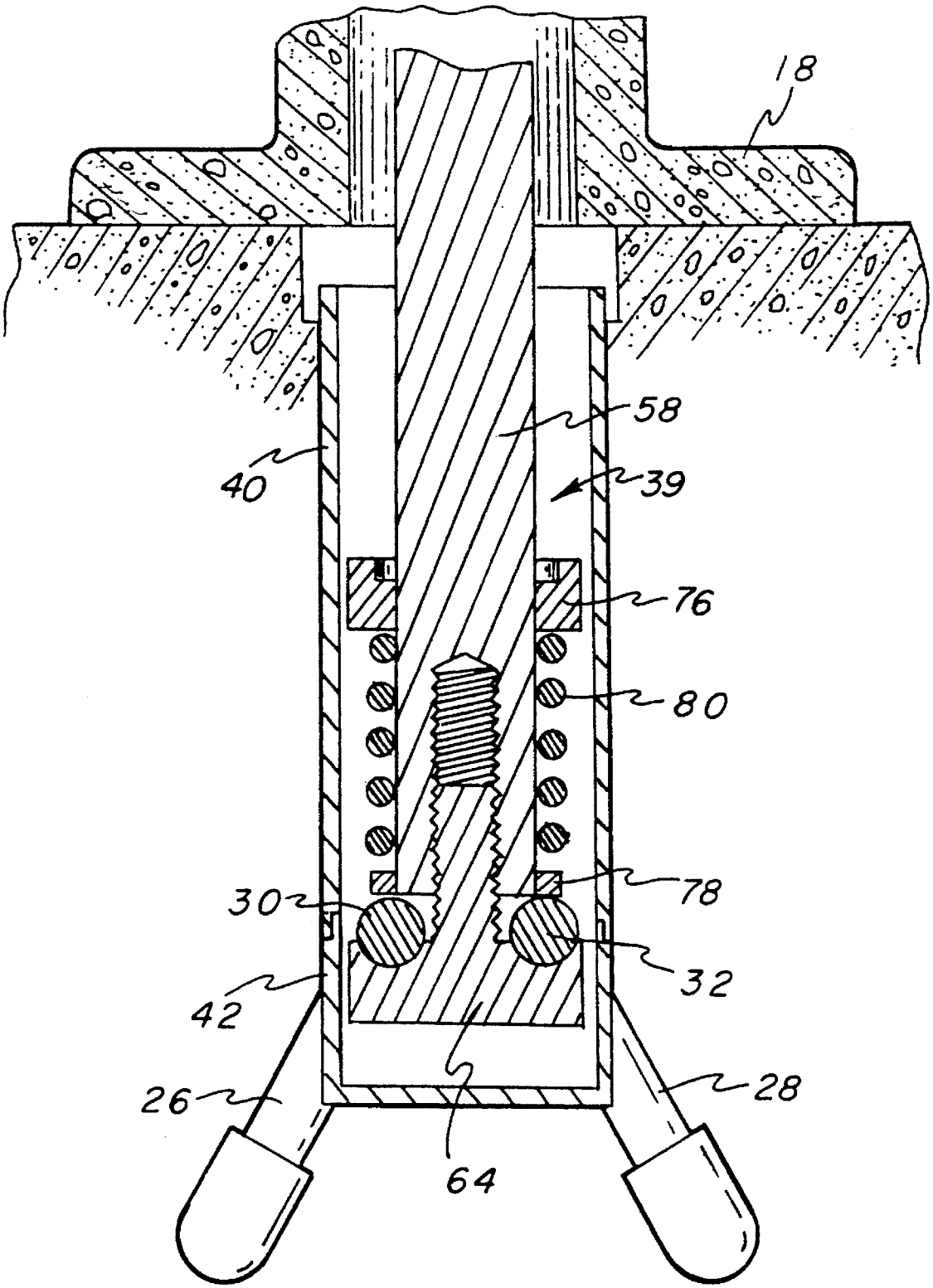
FIG. 5 is an enlarged, partial cross-sectional view of FIG. 2, where the strongback bolt is in the engaged position with the strongback insert.

A spring assembly 74 is also provided adjacent end 62 of shaft 58 in order to allow extension of strongback bolt 20 further into strongback insert 16 during compression thereof and to provide a bias toward threaded end 60 upon retention of engagement head 64 to base 24. Spring assembly 74 is comprised of a first member 76 (e.g., a bushing) fixedly positioned along shaft 58, a second member 78 (e. g., a washer) located adjacent engagement head 64, and a spring 80 positioned around shaft 58 between first member 76 and second member 78. It will be specifically noted that second member 78 is configured, as seen in FIG. 5, so as to be unable to pass between horizontal portions 30 and 32 of first and second leg members 26 and 28. In this way, second member 78 acts as a brace against base 24 to allow compression of spring 80.

Strongback bolt 20 also includes a wing nut 82 located along threaded end 60 of shaft 58, as well as a handle 84. Wing nut 82 is positioned along shaft 58 to secure strongback beam 18 against concrete panel 10 and may be adjusted along threaded end 60 in order to accommodate varying sizes of strongback beams 18. Handle 84 is utilized to rotate strongback bolt 20 and bring engagement head 64 into and out of engagement with first and second leg member horizontal portions 30 and 32.

Figure 6:
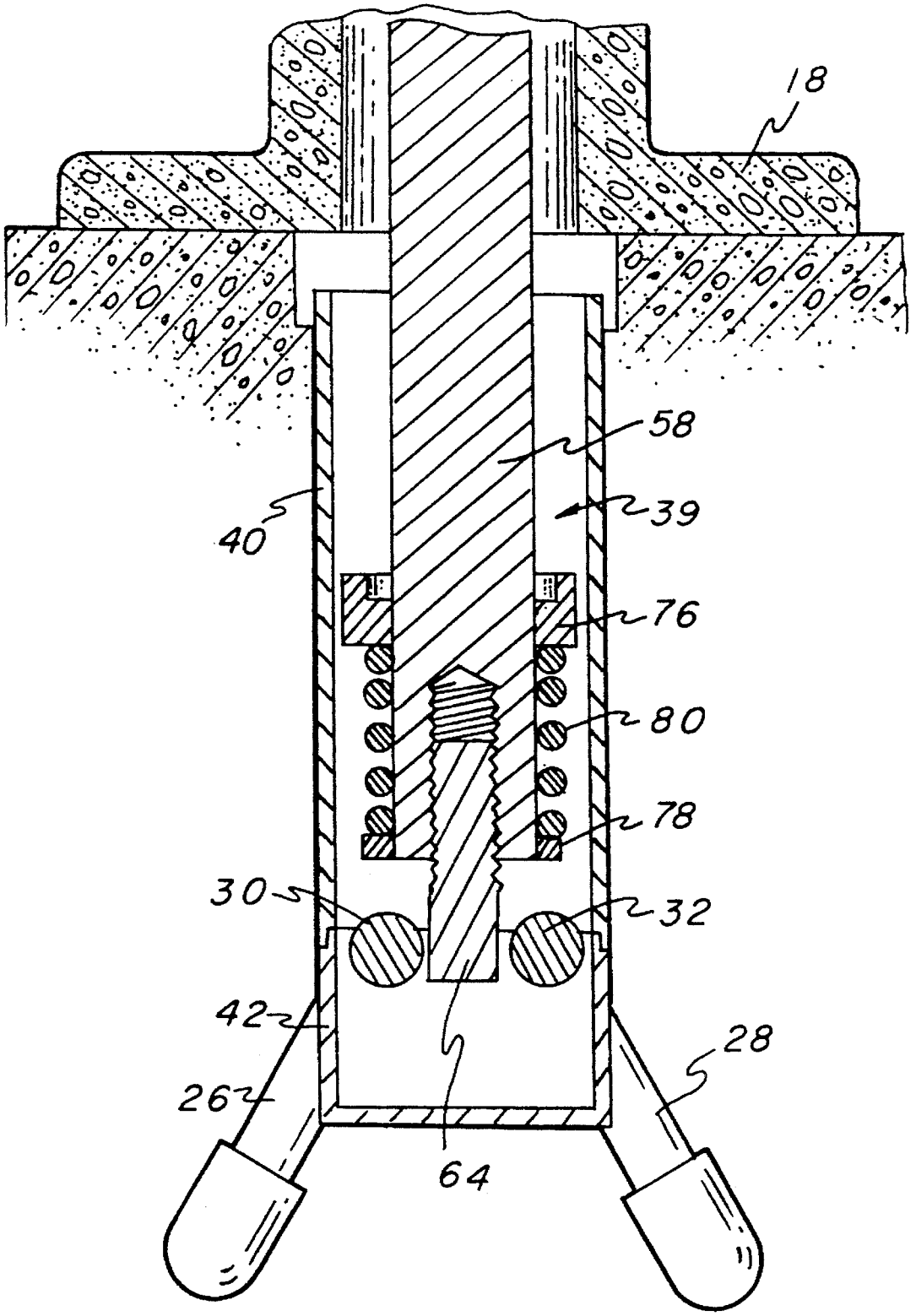
FIG. 6 is an enlarged, partial cross-sectional view of FIG. 2 like that of FIG. 5, where the strongback bolt is in the disengaged position with the strongback insert.

When implementing strongback system 14 of the present invention, it will be understood that strongback insert 16 is first positioned within concrete panel 10. Antennas 86 located on cap portion 44 of body 38 extend through an exterior surface 22 of concrete panel 10 to indicate the location of strongback insert 16. Thereafter, cap portion 44 may be removed in order to locate void 39 within concrete panel 10 formed by body 38 of strongback insert 16. Strongback beam 18 is then positioned along surface 22 of concrete panel 10 so that a passage 88 therethrough is aligned with void 39 in concrete panel 10. Strongback bolt 20 is then positioned through passage 88 in strongback beam 18 (see FIG. 2) and is oriented so that engagement head 64 thereof is able to pass between horizontal portions 30 and 32 of first and second base leg members 26 and 28, respectively, as depicted in FIG. 6. Strongback bolt 20 is then inserted until second member 78 of spring assembly 74 rests upon horizontal portions 30 and 32, whereupon spring 80 is compressed to allow strongback bolt 20, and particularly engagement head 64, to pass deeper into strongback insert 16 and below horizontal portions 30 and 32.

In accordance with the present invention, strongback bolt 20 is rotated, preferably approximately 90° in either direction, by means of handle 84 so that flanges 66 and 68 of engagement head 64 are aligned with horizontal portions 30 and 32. Spring 80 is then released from compression so that engagement head 64 is biased against horizontal members 30 and 32 toward threaded end 60. Preferably, horizontal portions 30 and 32 rest within slots 70 and 72 of flanges 66 and 68, respectively. Finally, wing nut 82 is then rotated along threaded end 60 of shaft 58 until strongback beam 18 is secured against surface 22 of concrete panel 10. To assist in this process, a securing member 90 may be positioned between wingnut 82 and strongback beam 18 (see FIG. 2).

It will be understood that strongback system 14 may be disassembled in reverse order, whereby wing nut 82 is loosened from strongback beam 18, strongback bolt 18 is released from strongback insert 16 by compressing spring 80 and rotating strongback bolt 18 approximately 90°, and strongback bolt 20 is removed from strongback insert 16 and strongback beam 18.

Having shown and described the preferred embodiment of the present invention, further adaptations of the system for attaching a strongback beam to a concrete panel can be accomplished by appropriate modifications by one of ordinary skill in the art without departing from the scope of the invention.

What is claimed:

1. A system for temporarily attaching a reinforcing beam or the like to a poured concrete structural member, comprising:

(a) an insert adapted to be set in a poured concrete member, said insert including:

(i) a body for creating a void in a concrete structural member, said body including an upper portion and a lower portion connected together along a mating surface; and (ii) a base supporting said body in spaced relation above a floor of a concrete structural member, said base having a pair of leg members in which a portion of each leg member extends through said body;

(b) a bolt for securing said reinforcing beam to a concrete structural member, said bolt including a shaft with an end terminating in an engagement head releasably engaged by said leg member portions extending through said body; and (c) wherein said upper and lower portions of said body each have a pair of aligned slots formed therein retaining said leg member portions extending through said body.

2. The system of claim 1, further comprising means for connecting said upper and lower body portions.

3. The system of claim 2, said connecting means comprising opposing tongue and groove projections along said mating surface.

4. The system of claim 1, said body further comprising a cap portion releasably attached to said body upper portion.

5. The system of claim 1 wherein said leg members extend through said body in substantially parallel relationship to each other.

6. The system of claim 5, said engagement head being adapted to pass between said leg member portions when oriented in a first position and to become retained by said leg member portions when oriented in a second position.

7. The system of claim 6, wherein said second position is accomplished by rotating said engagement head approximately 90° with respect to said first position.

8. The system of claim 6, wherein said engagement head is substantially T-shaped.

9. The system of claim 6, wherein said engagement head includes a pair of diametrically opposed flanges extending laterally outwardly from a longitudinal axis through said bolt.

10. The system of claim 9, said flanges each including a surface having a slot formed therein which is matable with said leg member portions.

11. A system for temporarily attaching a reinforcing beam or the like to a poured concrete structural member, comprising:

(a) an insert adapted to be set in a poured concrete member, said insert including:

(i) a body for creating a void in a concrete structural member; and (ii) a base supporting said body in spaced relation above a floor of a concrete structural member, said base having a pair of leg members in which a portion of each leg member extends through said body;

(b) a bolt for securing said reinforcing beam to a concrete structural member, said bolt including a shaft with a threaded end and an opposite end terminating in an engagement head releasably engaged by said leg member portions extending through said body; and (c) further comprising a fastener engageable with said bolt threaded end for securing said reinforcing beam to said concrete structural member.

12. A system for temporarily attaching a reinforcing beam or the like to a poured concrete structural member, comprising:

(a) an insert adapted to be set in a poured concrete member, said insert including:

(i) a body for creating a void in a concrete structural member; and (ii) a base supporting said body in spaced relation above a floor of a concrete structural member, said base having a pair of leg members in which a portion of each leg member extends through said body;

(b) a bolt for securing said reinforcing beam to a concrete structural member, said bolt including a shaft having opposing ends, one end of said shaft terminating in an engagement head releasably engaged by said leg member portions extending through said body; and (c) said bolt further comprising a spring biased portion along said shaft adjacent said engagement head, wherein said bolt is biased toward an end opposite from said engagement head when said engagement head is retained by said leg member portions.

13. The system of claim 12, said spring biased portion of said bolt including a first member fixedly positioned along said bolt shaft, a second member located adjacent said engagement head, and a spring member positioned around said shaft between said first and second members, wherein said second member is configured so as to be unable to pass between said leg member portions.

14. The system of claim 12, further comprising a handle positioned on said bolt shaft, wherein said bolt may be rotated to bring said engagement head into and out of engagement with said leg member portion.

15. A system for temporarily attaching a strongback beam or the like to a poured concrete structural member, comprising:

(a) a base adapted to be set in a poured concrete structural member, said base including a pair of members having a portion for extending substantially parallel to a plane defined by a concrete structural member; and (b) a bolt for securing said strongback beam to a concrete structural member, said bolt including a shaft having a threaded end and an opposite end terminating in an engagement head releasably engaged by said base member portions, said engagement head being integral with said shaft and further comprising:

(i) an engagement member connected to and extending axially from said shaft; and (ii) a spring biased portion compressible against said base member portions;

wherein said engagement member is able to extend past said base member portions when oriented in a first position and thereafter is able to be retained by said base member portions when oriented in a second position.

16. The system of claim 15, further comprising an insert for forming a void in a concrete structural member, said insert being located about said base member portions.

17. The system of claim 16, wherein said insert and said base are interconnected.

18. The system of claim 15, wherein said second position is accomplished by rotating said engagement member approximately 90° with respect to said first position.

19. The system of claim 15, further comprising a fastener engageable with said shaft threaded end for securing said strongback beam to a concrete structural member.

20. The system of claim 15, said spring biased portion of said shaft including a first member fixedly positioned along said shaft, a second member located adjacent said engagement head, and a spring member positioned around said shaft between said first and second members, wherein said second member is configured so as to be unable to pass between said base member portions.

21. The system of claim 15, further comprising a handle positioned on said shaft, wherein said shaft may be rotated to bring said engagement head into and out of engagement with said base member portions.

22. The system of claim 15, said engagement head including a pair of surfaces having a slot formed therein which is matable with said base member portions.

23. The system of claim 15, wherein said engagement head is substantially T-shaped.

24. The system of claim 15, wherein said engagement head includes a pair of diametrically opposed flanges extending laterally outwardly from a longitudinal axis through said bolt.

* * * * *